US007601475B2

(12) United States Patent
Katoh et al.

(10) Patent No.: US 7,601,475 B2
(45) Date of Patent: Oct. 13, 2009

(54) CARRIER AND DEVELOPING AGENT FOR ELECTROPHOTOGRAPHY

(75) Inventors: Takeshi Katoh, Kyoto (JP); Toshihisa Ishida, Kashiba (JP); Yoshinori Urata, Kashihara (JP); Kazuya Korematu, Nara (JP); Takeshi Takayama, Yamatokoriyama (JP); Mitsuhiro Hasegawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 407 days.

(21) Appl. No.: 11/518,902

(22) Filed: Sep. 12, 2006

(65) Prior Publication Data

US 2007/0059629 A1 Mar. 15, 2007

(30) Foreign Application Priority Data

Sep. 12, 2005 (JP) ..... P2005-264093

(51) Int. Cl.
*G03G 9/00* (2006.01)

(52) U.S. Cl. ..... 430/111.35; 430/111.32; 430/111.41

(58) Field of Classification Search ..... 430/111.35, 430/111.32, 111.41
See application file for complete search history.

(56) References Cited

U.S. PATENT DOCUMENTS 5,698,357 A 12/1997 Inoue et al.
2003/0044712 A1* 3/2003 Matsui et al. ..... 430/111.32
2005/0112489 A1* 5/2005 Fujikawa et al. ..... 430/111.35

FOREIGN PATENT DOCUMENTS

| | | |
|---|---|---|
| JP | 60-7443 A | 1/1985 |
| JP | 6-202381 | 7/1994 |
| JP | 7-64330 | 3/1995 |
| JP | 7-134437 | 5/1995 |
| JP | 8-6309 | 1/1996 |
| JP | 9-120174 | 5/1997 |
| JP | 2004-198745 A | 7/2004 |
| JP | 2004-240161 A | 8/2004 |
| JP | 2005-43569 A | 2/2005 |
| JP | 2005-49478 | 2/2005 |

* cited by examiner

*Primary Examiner*—Mark A Chapman
(74) *Attorney, Agent, or Firm*—Nixon & Vanderhye P.C.

(57) ABSTRACT

A two-component developing agent containing a carrier which can maintain a charge-imparting property to a toner at a high level for a long period of time, does not generate flying of the carrier and can correspond to an image forming apparatus of present day having a long operation life and can form a high-quality image having high image density and sharpness, is provided. In the two-component developing agent containing a carrier in which a resin coating layer is formed on a surface of a core material, and a toner, in which an X-ray intensity of an alumina particle by a fluorescent X-ray analysis, the amount of the alumina particle to be used to the resin coating layer is adjusted such that it comes to be smaller than the X-ray intensity by the fluorescent X-ray analysis of a metal contained in a largest amount in the core material.

4 Claims, 1 Drawing Sheet

CARRIER AND DEVELOPING AGENT FOR ELECTROPHOTOGRAPHY

BACKGROUND OF THE INVENTION

1. Field of the Invention

The present invention relates to a carrier and a developing agent for electrophotography.

2. Description of the Related Art

In an image forming apparatus such as a copying machine, a laser printer or a facsimile making use of electrophotographic techniques, an image is recorded by firstly forming an electrostatic latent image in a developing region on a photoreceptor in which a photosensitive layer is formed on a surface of a core metal, secondly developing the electrostatic latent image in the developing region on the photoreceptor by using a toner contained in a developing agent stocked in a developing device, thirdly transferring the resultant toner image on to a recording material and, then, fixing the thus-transferred toner image on the recording material by being thermally pressed with a fixing roller.

Recently, with a remarkable development of the electrophotographic techniques in line with popularization of computers, for example, durability of various types of devices which constitute the image forming apparatus is enhanced and, then, a longer operation life of the image forming apparatus is realized. Further, in the image forming apparatus, the developing agent to be used for forming the image is required to have a longer operational life, namely, stability of charging characteristics during a period of use thereof. And, then, by allowing the charging characteristics of the developing agent to be stabilized for a long period of time and allowing the toner contained in the developing agent to be imparted with a given charge, image density of the image to be recorded on the recording material is no more fluctuated and, then, a high-quality image having scarce image defect can stably be formed.

As for the developing agent, a two-component developing agent containing a toner particle which contains a binder resin and a coloring agent and develops an electrostatic latent image, and a magnetic carrier which is stirred with the toner particle in the developing device and, then, allows the toner particle to be friction-charged is widely utilized. As for the carrier, such carrier as having a core material and a resin coating layer provided on a surface of the core material is ordinarily utilized.

In order to enhance characteristics of the two-component developing agent, for example, using a developing device constituted such that the two-component developing agent can fully perform the characteristics thereof, selecting an appropriate type of the binder resin to be contained in the toner, selecting an appropriate type of the resin which constitutes a resin coating layer of the carrier, conducting a thermal treatment in order to enhance adhesiveness between the carrier and the resin coating layer, allowing an inorganic particle in the resin coating layer of the carrier or the like has conventionally been performed. Further, it is also known that alumina can be contained in the two-component developing agent as an additive.

For example, a two-component developing agent containing a carrier containing porous iron powder (a core material) having an irregular surface and a resin coating layer formed on a surface of the iron powder, and a toner in which a binder resin contains a fatty acid and/or a metal salt thereof is proposed (refer to, for example, Japanese Unexamined Patent Publication JP-A 7-64330 (1995)). Further, in the paragraph [0047] of JP-A 7-64330, it is described to add alumina to the resin coating layer. However, in a technique described in JP-A 7-64330, such addition of alumina is suggested only for a case in which the resin coating layer is constituted by a fluorocarbon resin. The fluorocarbon resin requires a high temperature of 300 to 400° C. at the time of being thermally fused to the core material and even a small difference of a thermal fusion temperature causes a difference of an electric property. For this reason, in carriers each having the resin coating layer containing the fluorocarbon resin, properties imparting charges to toners are, though being small, different from one another caused by differences of electric properties of fluorocarbon resins. Therefore, in the technique described in JP-A 7-64330, alumina is added for averaging the properties, of carriers, which impart the charges to the toners and alumina is not added for maintaining the properties thereof imparting charges to the toners at a high level for a long period of time. Further, in JP-A 7-64330, an effect of adding alumina to the resin coating layer is not specifically exhibited. Still further, a simple addition of the inorganic particle such as alumina to the resin coating layer generates a so-called carrier-flying phenomenon which causes a damage on a surface of the photoreceptor, an image defect or the like.

Further, a two-component developing agent containing porous iron powder (core material) having irregularity on a surface, and a toner in which a binder resin contains a polyester resin as a main component and, further, an ester amide and/or a salt thereof is proposed (refer to, for example, Japanese Unexamined Patent Publication JP-A 7-134437 (1995)). Further, in the paragraph [0044] of JP-A 7-134437, it is described that alumina can be added to a toner as a flowability improving agent. Namely, in JP-A 7-134437, it is only described that alumina is added as an external additive of the toner. Although alumina which adheres to the surface of the toner as the external additive adheres also to the surface of the carrier by stirring in the developing device, it does not enter inside the resin coating layer of the carrier. Under these conditions, the effect of stabilizing the charge-imparting property of the carrier for a long period of time can not be obtained.

Further, a carrier which contains a core material, an intermediate layer which is formed on a surface of the core material and contains alumina, and a surface layer which is formed on the surface of the intermediate layer and contains a condensate between N-alkoxyalkylated polyamide and a silicone resin containing a silanol group and/or alkoxy group is proposed (refer to, for example, Japanese Unexamined Patent Publication JP-A 2005-49478). However, the carrier described in JP-A 2005-49478 has a two-layer constitution in which a resin coating layer contains an intermediate layer and a surface layer and, further, the surface layer which is most deeply concerned with a charge-imparting property to a toner of the carrier is constituted only with a condensate between a specific polyamide and a silicone resin, without containing alumina. Still further, in a technique of JP-A 2005-49478, as described in the paragraph [0009], an addition of alumina to the intermediate layer is executed for the purpose of enhancing flowability of the carrier by imparting appropriate irregularity on the surface of the carrier. That is, in JP-A 2005-49478, a technical concept that a charge-imparting property of the carrier is stabilized for a long period of time by adding alumina into a resin coating layer is not disclosed. Further, the carrier described in JP-A 2005-49478 not only has a defect in that there is a problem in long-term adhesion between the intermediate layer and the surface layer but also has another defect in that, since it uses a specific synthetic resin and the resin coating layer has a two-layer constitution, production in an industrial scale is difficult.

SUMMARY OF THE INVENTION

An object of the invention is to provide a carrier in which a charge-imparting property to a toner is maintained at a high level for a long period of time, and generation of flying of the carrier is reduced and which can correspond also to an image forming apparatus of present day having a prolonged operational life, and a two-component developing agent which contains the carrier and is appropriate for forming a high-quality image having high image density and sharpness.

The invention provides a carrier comprising:

a core material, and a resin coating layer formed on a surface of the core material, the resin coating layer containing alumina particles, X-ray intensity of the alumina particles measured by a fluorescent X-ray analysis being smaller than that of a metal which is a metal contained in the core material in a largest amount measured by the fluorescent X-ray analysis.

According to the invention, the carrier comprises a core material and a resin coating layer containing alumina particles formed on a surface of the core material, and the alumina particles are added to the resin coating layer so that X-ray intensity of the alumina particles contained in the resin coating layer measured by a fluorescent X-ray analysis (hereinafter, unless stated otherwise, referred to simply as "X-ray intensity of alumina particles") is smaller than that of a metal which is a metal contained in a largest amount in the core material measured by the fluorescent X-ray analysis (hereinafter, unless state otherwise, referred to simply as "X-ray intensity of metal contained in core material"). Accordingly, the charge-imparting property to the toner is enhanced and further, the charge-imparting property is stably maintained at high level for a long period of time.

In addition, in the invention, it is preferable that a ratio between the X-ray intensity of the alumina particles in the resin coating layer measured by the fluorescent X-ray analysis and the X-ray intensity of the metal which is a metal contained in a largest amount in the core material measured by the fluorescent X-ray analysis (X-ray intensity of alumina particles/X-ray intensity of metal) is in a range of $3\times10^{-3}$ to $10\times10^{-3}$.

Further, in the invention, it is preferable that a ratio between the X-ray intensity of the alumina particles in the resin coating layer measured by the fluorescent X-ray analysis and the X-ray intensity of the metal contained in a largest amount in the core material measured by the fluorescent X-ray analysis (X-ray intensity of alumina particles/X-ray intensity of metal) is in a range of $3.5\times10^{-3}$ to $9.5\times10^{-3}$.

According to the invention, by adjusting an amount of the alumina particles to be added to the resin coating layer such that the ratio between the X-ray intensity of the alumina particles and the X-ray intensity of the metal contained in a largest amount in the core material (X-ray intensity of alumna particles/X-ray intensity of metal contained in core material) comes to be, preferably, in a range of $3\times10^{-3}$ to $10\times10^{-3}$ and, more preferably, $3.5\times10^{-3}$ to $9.5\times10^{-3}$, an effect of enhancing the charge-imparting property of the carrier and an effect of stably maintaining the charge-imparting property come to be further conspicuous, as well as flying of the carrier hardly occurs.

Further, in the invention, it is preferable that the core material is an iron-type magnetic material and the metal contained in the core material in the largest amount is iron.

According to the invention, by using the iron-type magnetic material, in which the metal contained in the largest amount in the core material is iron, as the core material, the core material which is the iron-type magnetite and the alumina particle in the resin coating layer react with each other in a synergistic manner, to thereby realize a further enhancement and a longer maintenance of the charge-imparting property of the carrier to the toner.

Further, in the invention, it is preferable that the resin coating layer contains at least one resin selected from among polyester, an acrylic resin and a silicone resin.

According to the invention, by arranging such that resin coating layer is constituted by one or two or more of resins selected from among polyester, the acrylic resin and the silicone resin, dispersibility of the alumina particles in the resin coating layer is increased, the alumina particle is uniformly dispersed in the resin coating layer, an effect of addition of the alumina particles is efficiently executed and, then, a long-term stability of the charge-imparting property to the toner is further enhanced.

Further, in the invention, it is preferable that the alumina particles are subjected to a surface treatment by at least one coupling agent selected from among a silane-type coupling agent, a titanium-type coupling agent and an aluminum-type coupling agent.

According to the invention, even by subjecting the alumina particles to the surface treatment by at least one coupling agent selected from among the silane-type coupling agent, the titanium-type coupling agent and the aluminum-type coupling agent, the dispersibility of the aluminum particles in the resin coating layer is increased, the alumina particles are uniformly dispersed in the resin coating layer, the effect of addition of the alumina particles is efficiently executed and, then, a long-term charge-imparting property to the toner can further be enhanced.

Further, in the invention, it is preferable that saturation magnetization in a magnetic field of 12000 Oe is in a range of 55 to 70 emu/g.

According to the invention, by performing such a comparatively easy operation as allowing the saturation magnetization in a magnetic field of 12000 Oe to be in a range of 55 to 70 emu/g, an object of the invention to enhance and maintain the charge-imparting property and to prevent the flying of the carrier can be attained at a high level and in a favorable balance.

Further, the invention provides a development agent for electrophotography comprising any one of the above-described carriers and the toner.

According to the invention, there is provided a developing agent for electrophotography, containing a carrier according to the invention and the toner, having nearly constant charge characteristics, capable of being favorably used in an image forming apparatus of electrophotographic method in which a prolonged operational life and a higher image forming speed have been realized and capable of forming a high-quality image having high image density and fineness.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
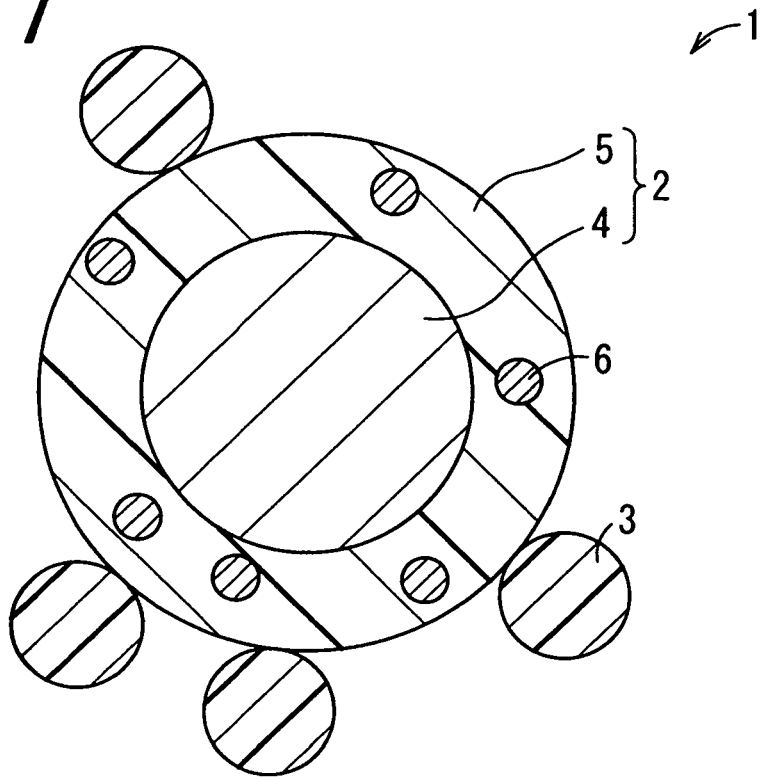
FIG. 1 is a cross-sectional diagram schematically showing a constitution of a two-component developing agent according to one embodiment of the invention.

Now referring to the drawings, preferred embodiments of the invention are described below.

A carrier according to the present invention is characterized in that an alumina particle is added in a resin coating layer formed on a surface of a core material such that an X-ray intensity of the alumina particle is allowed to be smaller than the X-ray intensity of a metal contained in a largest amount in the core material.

[Core Material]

As for the core material, materials which are ordinarily used in the relevant field can be used. For example, magnetic metals such as iron, copper, nickel, or cobalt, or magnetic oxides such as ferrite or magnetite are employed. Among these metals, iron which is contained in a largest amount, and an iron-type magnetic metal such as ferrite are preferable and ferrite is most preferable. As for the ferrite, known ferrites can be used. For example, zinc type ferrite, nickel type ferrite, copper type ferrite, nickel-zinc type ferrite, manganese-magnesium type ferrite, copper-magnesium type ferrite, manganese-zinc type ferrite, and manganese-copper-zinc type ferrite are mentioned. These ferrite type particles can be obtained by mixing raw materials and, then, firing the resultant mixture via provisional firing and pulverizing. On this occasion, it is possible to change surface profiles of particles by changing firing temperatures. A size of the core material is not particularly limited and a volume average particle diameter thereof is in a range of, preferably, 10 to 150 μm, more preferably 25 to 100 μm and, particularly preferably, 25 to 50 μm. A shape of the core material is not particularly limited. Although any one of spherical form, grainy form, amorphous, and flaky form is permissible, the spherical form is preferred. One type of the core materials can singly be used or two or more types thereof can simultaneously be used.

As for synthetic resins contained in the resin coating layer formed on the surface of the core material, those which are ordinarily used can be used. For example, a silicone resin, a fluorocarbon resin, a phenol resin, an epoxy resin, a urethane resin, an acrylic resin a styrene-acrylic resin, a styrene resin, polyester, polyamide, polyacetal, polycarbonate, polyvinyl chloride, a vinyl acetate resin, a cellulose resin, and polyolefin are mentioned. Among these resins, in view of easiness of thermal treatment for enhancing adhesiveness between the core material and the resin coating layer, less fluctuation of the charge-imparting property to the toner among individual carriers, and favorable abrasion resistance, thermal resistance, mechanical strength and the like, a silicone resin, an acrylic resin, and polyester are preferable and a silicone resin is particularly preferable. Specific examples of such silicone resins include silicone varnish (trade names: TSR 115, TSR 114, TSR 102, TSR 103, YR 3061, TSR 110, TSR 116, TSR 117, TSR 108, TSR 109, TSR 180, TSR 181, TSR 187, TSR 144, and TSR 165; available from Shin-Etsu Chemical Co., Ltd., and trade names: KR 271, KR 272, KR 275, KR 280, KR 282, KR 267, KR 269, KR 211, KR 212 and the like; available from Toshiba Corp.), alkyd-modified silicone varnish (trade names: TSR 184, TSR 185 and the like; available from Toshiba Corp.), epoxy-modified silicone varnish (trade names: TSR 194, YS 54 and the like; available from Toshiba Corp.), polyester-modified silicone varnish (trade names: TSR 187 and the like; available from Toshiba Corp.), acrylic-modified silicone varnish (trade names: TSR 170, TSR 171 and the like; available from Toshiba Corp.), urethane-modified silicone varnish (trade names: TSR 175 and the like; available from Toshiba Corp.), and reactive silicone resins (trade names: KA 1008, KBE 1003, KBC 1003, KBM 303, KBM 403, KBM 503, KBM 602, KBM 603 and the like; available from Shin-Etsu Chemical Co., Ltd.). One type of these synthetic resins can singly be used or two or more types thereof can simultaneously be used. An amount of anyone of these synthetic resins to be used is not particularly limited and is preferably used such that thickness of the resin coating layer comes to be in a range of 0.1 to 5 μm.

In the resin coating layer, an alumina particle is contained together with any one of the above-described synthetic resins. Mainly, by containing a specified amount of the alumina particle in the resin coating layer, the charge-imparting property of the carrier of the invention to the toner is enhanced and maintained at a high level for a long period of time. An amount of the alumina particle to be contained in the resin coating layer is an amount in which X-ray intensity of the alumina particle in the resin coating layer measured by a fluorescent X-ray analysis comes to be smaller than X-ray intensity of the metal contained in a largest amount in the core material measured by the fluorescent X-ray analysis. The ratio between the X-ray intensity of the alumina particle and the X-ray intensity of the metal contained in the metal (X-ray intensity of alumna particle/X-ray intensity of metal contained in core material) comes to be in the range of, preferably, $3\times10^{-3}$ to $10\times10^{-3}$ and, more preferably, $3.5\times10^{-3}$ to $9.5\times10^{-3}$. When the ratio between the two intensities is within the above-described ranges, enhancement of the charge-imparting property of the carrier to the toner, an effect of maintaining the property and an effect of preventing the flying of the carrier can be performed each at a high level. Even when the ratio is outside the above-described ranges, performance of the carrier to be obtained is not extremely deteriorated; however, over the long term, in less than the lower limit of the above-described range, there is a risk in that the charge-imparting property to the toner comes to be somewhat unstable, while, in more than the upper limit of the above-described range, there is a risk in that prevention of the flying of the carrier comes to be insufficient. A shape of the alumina particle is not particularly limited and any one of spherical form, grainy form such as squared-form, fibrous form, and flaky form is permissible. A size of the alumina particle is not particularly limited and an average particle diameter thereof is in a range of, preferably, 10 nm to 500 nm. As for the alumina particle, in order to enhance, for example, dispersibility thereof in the synthetic resin and, then, more efficiently perform the effect of enhancing and stabilizing the charge-imparting property thereof, the alumina particle is preferably subjected to a surface treatment. For the surface treatment, at least one type of coupling agent selected from among a silane-type coupling agent, a titanium-type coupling agent and an aluminum-type coupling agent which are known to persons in the art can be used. By performing such surface treatment as described above, an amount of alumina particle to be used can be reduced.

In the synthetic resin for the resin coating layer, in order to adjust resistance and the like of the carrier to be obtained, other inorganic particles, together with the alumina particle, can be added. As for such inorganic particles as described above, known inorganic particles can be used. Examples of such known inorganic particles include particles of silicon oxide, carbon black, graphite, zinc oxide, titanium black, iron oxide, titanium oxide, tin oxide, potassium titanate, calcium titanate, barium titanate, aluminum borate, magnesium oxide, barium sulfate and calcium carbonate. Among these inorganic particles, non-conductive inorganic particles are preferable. Conductivity of such non-conductive particle is in a range of, preferably, $1.0\times10^{1}$ to $1.0\times10^{6}$ Ωcm. One type of inorganic particle can singly be used or two or more types of inorganic particles can simultaneously be used. An amount of the additive to be used is not particularly limited and is in a range of, preferably, 0.1 to 20 parts by weight on the basis of 100 parts by weight of the synthetic resin in the resin coating layer.

In the synthetic resin for the resin coating layer, in the thermal treatment to be described below, in order to promote hardening of the resin coating layer, a drying accelerator can be added. Specific examples of such drying accelerators include metal soaps such as lead, iron, cobalt, manganese, and zinc salts of, for example, naphthylic acid and octylic acid, and organic amines such as ethanol amine.

The carrier according to the invention can be produced by coating the core material with the synthetic resin containing the alumina particle and, as need arises, any one of other inorganic particles and further, as required, performing a drying treatment and a thermal treatment.

At the time of coating the core material with the synthetic resin containing the alumina particle and, as need arises, any one of other inorganic particles, known methods such as a dipping method, a spray method, a fluid bed method, and a kneader-coater method can be adopted. For example, according to the dipping method, the carrier according to the invention can be obtained by dipping the core material in a solution or an aqueous dispersion of the synthetic resin containing the alumina particle and, as need arises, any one of other inorganic particles (hereinafter, referred to generically as "resin solution"). According to the spray method, the carrier according to the invention can be obtained by spraying the resin solution on the core material. According to the fluid bed method, the carrier according to the invention can be obtained by spraying the resin solution on the core material in a floating state by a flowing air. According to the kneader-coater method, the carrier according to the invention can be obtained by mixing the core material and the resin solution with each other in a kneader-coater and, then, removing liquid components such as a solvent and water. On this occasion, the solvent for preparing the resin solution is not particularly limited so long as it can dissolve or disperse the synthetic resin. Examples of such solvents include a romatic hydrocarbons such as toluene, and xylene, ketones such as acetone, and methyl ethyl ketone, ethers such as tetrahydrofuran and dioxane, higher alcohols, water and mixed solvents each containing two or more types of these solvents.

The drying treatment is performed for the purpose of removing the liquid components such as the solvent, and water remaining in the resin coating layer or a vicinity thereof.

The thermal treatment is performed for the purpose of, for example, enhancement of the mechanical strength by hardening the resin coating layer, and enhancement of adhesiveness between the resin coating layer and the core material. A temperature of the thermal treatment is not particularly limited, may appropriately be selected depending on the type of the synthetic resin contained in the resin coating layer and is ordinarily in a range of about 150 to about 400° C. When a silicone resin is contained in the resin coating layer, the temperature is in a range of about 150 to about 260° C.

In such manner as described above, the carrier can be obtained in which a thickness of the resin coating layer is about 5 μm or less and, preferably, in a range of about 0.1 to about 3 μm.

As for the carrier according to the invention, such carrier as having the saturation magnetization of 55 to 70 emu/g in a magnetic field of 12000 Oe is preferable. When the saturation magnetization is within the above-described range, the flying of the carrier can further surely be prevented without impairing the charge-imparting property of the carrier to the toner. In order to adjust the saturation magnetization so as to be in the above-described range, methods of, for example, selection of the core material, adjustment of the amount of the alumina particle to be used, and adjustment of component ratios of core materials are mentioned. Adjustment of the saturation magnetization to be within the above-described range is performed, particularly, by adjusting component ratios of core materials. Meanwhile, in order to allow the saturation magnetization to be within the above-described range by adjusting the amount of the alumina particle to be used, the X-ray intensity of the alumina particle is allowed to be within the range specified by the invention and, also, the aluminum particle may be used in an amount of 20 parts by weight or less, preferably from 1 to 17 parts by weight and, more preferably, from 5 to 15 parts by weight on the basis of 100 parts by weight of a synthetic resin in the coating layer.

A size of the carrier according to the invention is not particularly limited and a volume average particle diameter thereof is in a range of, preferably, 20 to 150 μm and, more preferably, 25 to 90 μm. Although the carrier according to the invention can use the carrier produced by the above-described method as it is, it is preferable to perform a classification operation which removes fine powder having a volume average less than 20 μm in particle diameter. By this operation, generation of flying of the carrier can further be reduced. The classification operation can be performed by using an ordinary classification apparatus.

Further, the carrier according to the invention may either be conductive or non-conductive and a shape thereof is not particularly limited; however, it is preferable that the carrier is non-conductive, has a high electric resistance and is spherical.

[Two-component Developing Agent]

The two-component developing agent according to the invention contains the toner and the carrier according to the invention. The carrier according to the invention is as described above.

(Toner)

The toner contained in the two-component developing agent according to the invention is not particularly limited. Any types of toners which are ordinarily used in the field of the image forming technique by the electrophotographic method can be used and toners containing, for example, a binder resin and a coloring agent as essential components and, further, a charge control agent, a parting agent, a flowability improving agent and the like, as need arises, can be mentioned.

(Binder Resin)

As for such binder resins, resins which are ordinarily used in the relevant field can be used. Examples of the resins include styrene type polymers, polyvinyl chloride, phenolic resins, natural modified phenolic resins, natural modified maleic acid resins, acrylic resins, methacrylic resins, polyvinyl acetate, silicone resins, polyester, polyurethane, polyamide resins, furan resins, epoxy resins, xylene resins, polyvinyl butyral, terpene resins, coumarone-indene resins, and petroleum resins.

Among these resins, a styrene type polymer and polyester are preferable. Examples of such styrene type polymers include styrene type homopolymers and styrene type copolymers. Examples of the styrene type homopolymers include homopolymers of styrene derivatives such as polystyrene, poly-p-chlorostyrene, and polyvinyl toluene. On the other hand, in the styrene type copolymers, as for comonomers which can be used together with styrene, known vinyl type monomers can be used. Examples of the vinyl type monomers include (meth)acrylic acid esters and derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, or octyl methacrylate; a dicarboxylic acid having a double bond and a derivative thereof such as maleic acid, butylmaleate, methyl maleate, and dimethyl maleate; vinyl esters such as vinyl chloride, vinyl acetate, and vinyl benzoate; ethylene type olefins such as ethylene, propylene, and butylene; vinyl ketones such as vinyl methyl ketone, and vinyl hexyl ketone; and vinyl ethers such as vinyl methyl ether, vinyl ethyl ether, and vinyl isobutyl ether; acrylonitrile, methacrylonitrile, and acrylamide. Any one type of these vinyl type monomers can singly be used or two or more types thereof can simultaneously be used. Specific examples of such styrene type copolymers containing these vinyl type monomers include a styrene-p-chlorostyrene copolymer, a styrene-vinyl toluene copolymer, styrene-vinyl naphthalene copolymers, styrene-acrylic acid ester copolymers, styrene-methacrylic acid ester copolymers, styrene-methyl-α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene copolymers.

Among these members, the styrene type polymer which is crosslinked by a crosslinking agent is preferable. As for the crosslinking agent, a compound mainly having two or more polymerizable double bonds is used. Examples of such compounds include aromatic divinyl compounds such as divinyl benzene and divinyl naphtalene; carboxylic acid esters each mainly having two or more polymerizable double bonds such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds each having three or more vinyl groups. Any one type of these crosslinking agents can singly be used or two or more types thereof can simultaneously be used.

Further, among these members, those in each of which a weight average molecular weight (Mw) as measured with gel permeation chromatography (GPC) is in a range of $15\times10^4$ to $25\times10^4$ and a number average molecular weight (Mn) as measured with gel permeation chromatography (GPC) is in a range of $2\times10^3$ to $4\times10^3$ are preferable. Further, those in each of which a softening point is in a range of 145 to 165° C. and a loss elastic modulus G" at 140° C. is in a range of $1\times10^4$ to $2\times10^4$ dyn/cm$^2$ are preferable.

As for polyester, a polycondensate between a polyhydric alcohol and a polyvalent carboxylic acid is mentioned. On this occasion, examples of such polyhydric alcohols include aliphatic polyhydric alcohols, heterocyclic polyhydric alcohols and aromatic polyhydric alcohols. Examples of the aliphatic polyhydric alcohols include aliphatic diols such as ethylene glycol, propylene glycol, 1,3-propanediol, 2,3-butanediol, 1,4-butanediol, 1,5-pentanediol, 1,6-hexanediol, neopentyl glycol, diethylene glycol, dipropylene glycol, 2,2,4-trimethyl-1,3-pentanediol, polyethylene glycol, and polytetramethylene glycol; triols and tetraols such as trimethylol ethane, trimethylol propane, glycerin and pentaerythritol. Examples of the alicyclic polyhydric alcohols include 1,4-cyclohexanediol, 1,4-cyclohexane dimethanol, spiroglycol, hydrogenated bisphenol A, a hydrogenated bisphenol A ethylene oxide adduct and a hydrogenated bisphenol A propylene oxide adduct, tricyclodecanediol and tricyclodecane dimethanol. Examples of the aromatic polyhydric alcohols include p-xylene glycol, m-xylene glycol, o-xylene glycol, 1,4-phenylene glycol, a 1,4-phenylene glycol ethylene oxide adduct, bisphenol A, a bisphenol A ethylene oxide adduct and a bisphenol A propylene oxide adduct. Any one type of the polyhydric alcohols can singly be used or two or more types thereof can simultaneously be used. The polyhydric alcohol may be such polyhytdric alcohol as containing a monoalcohol such as an aliphatic alcohol, an aromatic alcohol or an alicyclic alcohol.

Examples of polyvalent carboxylic acids include aromatic dicarboxylic acids such as terephthalic acid, isophthalic acid, o-phthalic acid, 1,5-naphthalene dicarboxylic acid, 2,6-naphthalene dicarboxylic acid, anthracene dipropionic acid, anthracene dicarboxylic acid, diphenic acid, sulfoterephthalic acid, 5-sulfoisoterephthalic acid, 4-sulfophthalic acid, 4-sulfonaphthalene-2,7-dicarboxylic acid, 5-(4-sulfophenoxy)isophthalic acid, metal salts and ammonium salts thereof; aliphatic dicarboxylic acids such as succinic acid, adipic acid, azelaic acid, sebacic acid, and dodecane dicarboxylic acid; aliphatic unsaturated polyvalent carboxylic acids such as fumaric acid, maleic acid, itaconic acid, and citraconic acid; aromatic unsaturated polyvalent carboxylic acids such as phenylene diacrylic acid; alicyclic dicarboxylic acids such as hexahydrophthalic acid and tetrahydrophthalic acid; and polyvalent (trivalent or more) carboxylic acids such as trimellitic acid, trimesic acid and pyromellitic acid. Any one type of the polyvalent carboxylic acids may singly be used or two or more types thereof can simultaneously be used. As need arises, a monocarboxylic acid can be used together with the polyvalent carboxylic acid. As for such monocarboxylic acids, aromatic monocarboxylic acids are preferable. Examples of the aromatic monocarboxylic acids include benzoic acid, chlorobenzoic acid, brompbenzoic acid, p-hydroxybenzoic acid, naphthalenecarboxylic acid, tert-butylnaphthalenecarboxylic acid, anthracene carboxylic acid, 4-methyl benzoic acid, 3-methyl benzoic acid, tert-butyl benzoic acid, salicylic acid, thiosalicylic acid, phenyl acetic acid, lower alkyl esters of these acids, a sulfobenzoic acid monoammonium salt, a sulfobenzoic acid monosodium salt, cyclohexylaminocarbonyl benzoic acid, and n-dodecylaminocarbonyl benzoic acid. Polycondensation between the polyhydric alcohol and the polyvalent carboxylic acid can be performed in accordance with a known method.

(Coloring Agent)

As for the coloring agent, known coloring agents in the relevant field may be used. Examples of such coloring agents include coloring agents for yellow toner, coloring agents for magenta toner, coloring agents for cyan toner and coloring agents for black toner.

Examples of the coloring agents for yellow toner include, in accordance with classification by color indices, azo type pigments such as C.I. Pigment Yellow 1, C.I. Pigment Yellow 5, C.I. Pigment Yellow 12, C.I. Pigment Yellow 15, and C.I. Pigment Yellow 17; inorganic type pigments such as yellow iron oxide, and yellow ocher; nitro type pigments such as C.I. Acid Yellow 1; and oil-soluble dyes such as C.I. Solvent Yellow 2, C.I. Solvent Yellow 6, C.I. Solvent Yellow 14, C.I. Solvent Yellow 15, C.I. Solvent Yellow 19, and C.I. Solvent Yellow 21.

Examples of coloring agents for magenta toner include, in accordance with classification of color indices, C.I. Pigment Red 49, C.I. Pigment Red 57, C.I. Pigment Red 81, C.I.

Pigment Red 122, C.I. Solvent Red 19, C.I. Solvent Red 49, C.I. Solvent Red 52, C.I. Basic Red 10, and C.I. Disperse Red 15.

Examples of coloring agents for cyan toner include, in accordance with classification by color indices, C.I. Pigment Blue 15, C.I. PigmentBlue 16, C.I. SolventBlue 55, C.I. Solvent Blue 70, C.I. Direct Blue 25, and C.I. Direct Blue 86.

Examples of coloring agents for black toner include various types of carbon black such as channel black, roller black, disk black, gas furnace black, oil furnace black, thermal black, and acetylene black. Appropriate carbon black may be selected from among these various types of carbon black in accordance with design characteristics of toner intended to be obtained.

Any one type of coloring agents can singly be used or two or more types thereof can simultaneously be used. Further, two types or more of same color types of coloring agents can be used and, also, one type or two or more types of each of different color types can be used.

An amount of the coloring agent to be used is not particularly limited and is, based on 100 parts by weight of binder resin, preferably, in a range of 5 to 20 parts by weight. By using the coloring agent in such range as described above, an image, having a high image density, of an extremely high image quality can be formed without impairing various types of properties of the toner.

(Charge Control Agent)

As for the charge control agent, those ordinarily used in the relevant field for controlling a positive charge and, also, for controlling a negative charge can be used. Examples of such charge control agents for controlling the positive charges include basic dyes, quaternary ammonium salts, aminopyrine, pyrimidine compounds, polynuclear polyamino compounds, aminosilanes, and nigrosine type dyes. Examples of such charge control agents for controlling the negative charges include oil-soluble dyes such as oil black, and spiron black; metal-containing azo type compounds; naphthenic acid metal salts; salicylic acid metal salts; fatty acid soap; and resin acid soap. Any one type of charge control agents can singly be used or two or more types thereof can simultaneously be used. Although an amount of the charge control agent to be used is not particularly limited and can appropriately be selected from a broad range, the amount is, based on 100 parts by weight of binder resin, preferably, in a range of 0.5 to 3 parts by weight.

(Parting Agent)

As for the parting agent, those as ordinarily used in the relevant field can be used. Examples of such parting agents include petroleum type wax such as paraffin wax and derivatives thereof, and microcrystalline wax and derivatives thereof; hydrocarbon type synthetic wax such as Fischer-Tropsch wax and derivatives thereof, polyolefin wax and derivatives thereof, low molecular weight polypropylene wax and derivatives thereof, and low molecular weight polyethylene wax and derivatives thereof; vegetable type wax such as carnauba wax and derivatives thereof, rice wax and derivatives thereof, canderilla wax and derivatives thereof, and haze wax; animal type wax such as bee's wax, and whale wax; oil and fat type synthetic wax such as fatty amides, and phenol fatty esters; long chain carboxylic acids and derivatives thereof; and long chain alcohols and derivatives thereof. Further, examples of these derivatives include oxides, block copolymers of the vinyl type monomers and the waxes, and graft modification substances between the vinyl type monomers and the waxes. Although an amount of the wax to be used is not particularly limited and can appropriately be selected from a broad range, it is, based on 100 parts by weight of the binder resin, preferably in a range of 0.2 to 20 parts by weight.

(Flowability Improving Agent)

The flowability improving agent is used as an exterior additive and can perform an effect thereof by allowing it to adhere to a surface of toner. As for the flowability improving agent, those as ordinarily used in the relevant field can be used. Examples of such flowability improving agents include silicon oxide, titanium oxide, silicon carbide, aluminum oxide, and barium titanate. Any one type of the flowability improving agents can singly be used or two or more types thereof can simultaneously be used. An amount of the flowability improving agent to be used is not particularly limited and is, based on 100 parts by weight of toner particle, preferably, in a range of 0.1 to 3.0 parts by weight.

The toner particle to be used in the two-component type developing agent according to the invention can be produced in accordance with a known method. For example, the binder resin, the coloring agent and the charge control agent and, as need arises, other additives are mixed by using a mixer such as a Henschel mixer, a Super mixer, a Mechano Mill, or a Q type mixer and, then, the resultant mixture is melt-kneaded at a temperature of about 70 to about 180° C. by using a kneader such as a twin-screw kneader, a single-screw kneader, or a continuous two-roll type kneader and, subsequently, the resultant kneaded article is cool-solidified and, then, the thus-solidified article was crushed by using an air-type crusher such as a jet mill and, thereafter, as need arises, particle adjustment such as classification is performed, to thereby obtain toner particles having an average particle diameter of, preferably, 3 to 15 μm and, more preferably, 6.0 to 7.5 μm.

Further, according to the invention, since the coloring agent of, base on the entire weight of toner particles, 10% by weight is allowed to be contained in the toner particle, in view of efficiently producing the toner by uniformly dispersing the coloring agent and other additives in the binder resin without impairing properties of the binder resin, it is preferable to adopt a master batch method at the time of producing the toner particle.

According to the master batch method, an amount of the binder resin which is smaller than that required and a required amount of the coloring agent are mixed with each other by using the mixer in a same manner as described above and the resultant mixture are kneaded by using the continuous two-roll type kneader while adding a shear force. The resultant kneaded article is cool-solidified and, then, the resultant solidified article was roughly crushed to obtain a roughly crushed article of the kneaded article. The remaining binder resin and other additives are mixed to the thus-obtained roughly crushed article of the kneaded article and, then, dilute-kneaded by using an extruder and, thereafter, the resultant kneaded article was cool-solidified, crushed and further, as need arises, performing a particle-size adjustment in a same manner as described above, to thereby obtain the toner particles.

Although a ratio between the toner in the two-component developing agent according to the invention and the carrier according to the invention to be used is not particularly limited and can appropriately be selected from a broad range in accordance with an image forming speed to be set in an image forming apparatus, an image density, a development bias voltage, a supply bias voltage, a supply capacity of the toner into the developing device, the toner and the carrier are preferably mixed with each other such that a ratio of a surface area of the carrier against a projected area of the toner falls in the range of 30 to 70%. When this range is shown in terms of weight reference, a ratio of toner to be used is, based on 100 parts by weight of the carrier, in a range of about 1 to about 10 parts by weight and, preferably, about 1.5 to about 5.5 parts by weight.

FIG. 1 is a cross-sectional diagram schematically showing a constitution of a two-component developing agent according to one embodiment of the invention. The two-component developing agent 1 according to the invention contains a carrier 2 which contains a core material 4, and a resin coating layer formed on a surface of the core material 4 and containing an alumina particle 6, and a toner 3. The toner 3 is ordinarily displaced together with the carrier 2 in the developing device in a state of being attached to the resin coating layer on the surface of the carrier 2.

The two-component developing agent according to the invention can advantageously be used in various types of image forming apparatuses each utilizing an electrophotographic method such as a copying machine, a printer and a facsimile.

EXAMPLES

Hereinafter, the present invention is described in detail with reference to examples and reference examples. Unless stated otherwise, all parts are given by weight.

Further, X-ray intensities of the alumina particle and the metal contained in the core material, an initial Q/M, a life Q/M, a charge holding ratio, the number of sheets, saturation magnetization of the carrier and flying of the carrier are evaluated in such manners as described below.

[X-ray Intensity]

With reference to fluorescent X-ray analyses of the alumna particle and the metal contained in the core material, characteristic X-ray intensity was measured under following conditions:

a fluorescent X-ray analyzer (trade name: ZSX-Primus II; manufactured by Rigaku Industrial Corp.) was used;

a target of and X-ray source: Rh;

voltage applied to the X-ray source: 40 kV;

current value: 50 mA;

LiF (target: alumina particle) or pentaerythritol (PET; target: metal contained in core material, being iron in the present example) was used as an analyzing crystal of an optical system;

a scintillation counter and a photo-counter were used as detectors; and scanning of the detectors was performed by using a skip-scanning method while an angle of 0.05° per step was set.

[Initial Q/M]

The term "initial Q/M" as used herein means a charged amount of a toner in an initial developing agent (developing agent at the time of initially (on a first sheet) forming the image) at the time of performing the image forming by using a black-and-white copying machine (trade name: AR-450; manufactured by Sharp Corp.). A measuring method is as described below.

By using 0.2 g of developing agent having a toner concentration of B% by weight as a sample, a measurement was conducted by using a blowoff machine (trade name: TB-200 Model; manufactured by Kyocera Chemical Corp.; blowoff pressure: 1.0 kg/cm$^2$). A blowoff value A after 30 seconds was determined and, then, a charged amount (μC/g) of the toner was computed by the following formula:

$$\text{Charged amount } (\mu C/g) = AX100/(BX0.2).$$

[Life Q/M]

The term "life Q/M" as used herein means a charged amount of a toner in a life developing agent (developing agent after in use for a predetermined period of time) at the time of performing the image forming by using the black-and-white copying machine (trade name: AR-450; manufactured by Sharp Corp.). A measuring was performed in a same manner as in the initial Q/M.

[Charge Holding Ratio]

$$\text{Charge holding ratio } (\%) = (\text{initial } Q/M)/(\text{life } Q/M) \times 100$$

[Number of Sheets (K)]

The total number of sheets copied in a period in which the developing agent was used.

[Saturation Magnetization]

By using a B-H tracer (trade name: BHU-60 Model; manufactured by Riken Denshi. Co., Ltd.), saturation magnetization was determined from a hysteresis curve obtained by applying a magnetic field of 12000 oersted (Oe).

[Flying of Carrier]

When a latent image of a white solid image was formed on a photoreceptor by using a black-and-white copying machine (trade name: AR-450; manufactured by Sharp Corp.), flying of the carrier was shown as the number of carrier which adhered on the photoreceptor. Further, with reference to the flying of the carrier, when the number of the carrier adhered on the photoreceptor was less than 50, there is no practical problem. However, the number is, preferably, 30 or less and, more preferably, 15 or less.

Production Example 1

| [Production of toner] | |
|---|---|
| Polyester (trade name: EPA 501; produced by Sanyo Chemical Industries, Ltd.) | 100 parts |
| Polyethylene wax (parting agent; trade name: PE 130; produced by Clariant (Japan) K. K.) | 1.0 part |
| Polypropylene (parting agent; trade name: NP-505; produced by Mitsui Chemicals, Inc.) | 1.5 part |
| Carbon black (coloring agent; trade name: 330R; produced by Cabbot Speciality Chemicals, Inc.) | 10 parts |
| Charge control agent (trade name: S-34; produced by Hodogaya Chemical Co., Ltd.) | 1 part |

Predetermined amounts of raw materials as described above were mixed by using a super mixer (trade name: V-20; manufactured by Kawada K.K.) and, then, the resultant mixture was melt-kneaded by using a twin-screw kneader (trade name: PCM-30; manufactured by Ikegai Corporation). The resultant kneaded article was crushed by using a jet type crusher (trade name: IDS-2; manufactured by Nippon Pneumatic Mfg., Co., Ltd.) and, then, classified, to thereby obtain toner matrix particles having a volume average particle diameter of 7.5 μm. Thereafter, 0.3 part of silica particles (trade name: R972; produced by Nippon Aerosil Co., Ltd.) were added to the thus-obtained toner matrix particles, to thereby prepare black toner. On this occasion, the volume average particle diameter was measured by using a Coulter Counter (trade name: TA-II; manufactured by Coulter Electronics, Inc.).

Example 1

[Production of Carrier]

100 parts (on a solid content basis) of silicone resin (trade name: KR-255; produced by Shin-Etsu Chemical Co., Ltd.) and 20 parts of alumina particles (volume average particle diameter: 10 nm) were dispersed in toluene, to thereby obtain a dispersion for forming a resin coating layer.

The thus-obtained dispersion for forming the resin coating layer was applied on 100 parts of Mn—Mg type ferrite core material (volume average particle diameter: 50 μm; core material) by using a fluid bed type coating apparatus, heated for 2 hours at 250° C., to thereby produce a carrier according to the invention.

Example 2

A carrier according to the invention was produced in a same manner as in Example 1 except that an amount of the alumina particles to be used was changed from 20 parts to 15 parts.

Example 3

A carrier according to the invention was produced in a same manner as in Example 1 except that an amount of the alumina particles to be used was changed from 20 parts to 10 parts.

Example 4

A carrier according to the invention was produced in a same manner as in Example 1 except that an amount of the alumina particles to be used was changed from 20 parts to 5 parts.

Example 5

A carrier according to the invention was produced in a same manner as in Example 1 except that a composition ratio (Fe element/Mg element) of a core material was adjusted and, also, the saturation magnetization was changed into 60.

Example 6

A carrier according to the invention was produced in a same manner as in Example 1 except that a composition ratio (Fe element/Mg element) of a core material was adjusted and, also, the saturation magnetization was changed into 50.

Example 7

Classification was performed on a carrier according to the invention to be obtained in a same manner as in Example 1, to thereby remove fine powder having a particle diameter of less than 20 μm.

Example 8

[Production of Two-component Developing Agent]

The toner particles obtained in Reference Example 1 and the silicone resin-coated carrier obtained in any one of Examples 1 to 7 were mixed with each other such that a coating ratio of the silicone resin carrier by the toner particles comes to be 35%, to thereby produce a two-component developing agent.

Comparative Example 1

A conventional carrier was produced in a same manner as in Example 1 except that the alumina particle was not used. A two-component type developing agent for comparison was produced in a same manner as in Example 7 except that the thus-produced carrier was used.

Test Example 1

Performance tests were conducted in accordance with the above-described test methods on the two-component developing agents obtained in Example 7 and Comparative Example 1.

TABLE 1

| | | Saturation magnetization emu/g | Al/Fe intensity ratio | Initial Q/M | Life Q/M | Sheet number K | Charge holding ratio | Fine powder | Flying of carrier (pieces) |
|---|---|---|---|---|---|---|---|---|---|
| Example | 1 | 70 | $1.52 \times 10^{-2}$ | 21.7 | 17.5 | 23 | 80.6 | Present | 49 |
| | 2 | 70 | $9.41 \times 10^{-3}$ | 19.4 | 14.1 | 38 | 72.7 | Present | 26 |
| | 3 | 70 | $6.61 \times 10^{-3}$ | 18.5 | 15.1 | 38 | 81.6 | Present | 10 |
| | 4 | 70 | $3.58 \times 10^{-3}$ | 18.8 | 14.8 | 38 | 78.7 | Present | 9 |
| | 5 | 60 | $1.37 \times 10^{-2}$ | 24.2 | 18.5 | 23 | 76.4 | Present | 31 |
| | 6 | 50 | $1.27 \times 10^{-2}$ | 25.9 | 19.0 | 23 | 73.5 | Present | 11 |
| | 7 | 70 | $1.20 \times 10^{-2}$ | 22.7 | 18.5 | 23 | 81.5 | Absent | 31 |
| Comparative Example 1 | | 70 | $6.50 \times 10^{-4}$ | 22.8 | 12.0 | 38 | 52.6 | Present | 24 |

Example 9

A carrier according to the invention having a saturation magnetization of 50 was produced in a same manner as in Example 6 except that an amount of the alumina particles to be used was changed from 20 parts to 15 parts.

Example 10

A carrier according to the invention having a saturation magnetization of 50 was produced in a same manner as in Example 6 except that an amount of the alumina particles to be used was changed from 20 parts to 10 parts.

Example 11

A carrier according to the invention having a saturation magnetization of 50 was produced in a same manner as in Example 6 except that an amount of the alumina particles to be used was changed from 20 parts to 5 parts.

Example 12

A two-component developing agent according to the invention was produced in a same manner as in Example 7 except that the carrier obtained in any one of Examples 9 to 11 was used. By using the thus-obtained two-component developing agent, the numbers of the flying of the carriers were inspected in accordance with the above-described test methods and were found to be 15 pieces (Example 9), 11 pieces (Example 10) and 11 pieces (Example 11).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A carrier comprising:

a core material, and a resin coating layer formed on a surface of the core material, the resin coating layer containing alumina particles, X-ray intensity of the alumina particles measured by a fluorescent X-ray analysis being smaller than that of a metal which is a metal contained in the core material in a largest amount measured by the fluorescent X-ray analysis, wherein a ratio between the X-ray intensity of the alumina particles in the resin coating layer measured by the fluorescent X-ray analysis and the X-ray intensity of the metal which is a metal contained in a largest amount in the core material measured by the fluorescent X-ray analysis (X-ray intensity of alumina particles/X-ray intensity of metal) is in a range of $3.58\times10^{-3}$ to $1.52\times10^{-2}$, the core material is an iron-type magnetic material having particles of a volume average particle diameter in a range of 10 μm to 150 μm, alumina particles have an average particle diameter of 10 nm to 500 nm, the amount of alumina particles is 5 to 15 parts by weight on the basis of 100 parts by weight of the synthetic resin in the coating layer, and the synthetic resin contains at least one resin selected from among a polyester, an acrylic resin, and a silicone resin.

2. The carrier of claim 1, wherein the alumina particles are subjected to a surface treatment by at least one coupling agent selected from among a silane-type coupling agent, a titanium-type coupling agent and an aluminum-type coupling agent.

3. The carrier of claim 1, wherein saturation magnetization in a magnetic field of 12000 Oe is in a range of 55 to 70 emu/g.

4. A development agent for electrophotography comprising the carrier of claim 1 and the toner.

* * * * *